US009589524B2

(12) United States Patent
Park

(10) Patent No.: US 9,589,524 B2
(45) Date of Patent: Mar. 7, 2017

(54) DISPLAY DEVICE AND METHOD FOR DRIVING THE SAME

(71) Applicant: LG DISPLAY CO., LTD., Seoul (KR)

(72) Inventor: Daekyu Park, Paju-Si (KR)

(73) Assignee: LG DISPLAY CO., LTD., Seoul (KR)

( * ) Notice: Subject to any disclaimer, the term of this patent is extended or adjusted under 35 U.S.C. 154(b) by 80 days.

(21) Appl. No.: 14/584,572

(22) Filed: Dec. 29, 2014

(65) Prior Publication Data

US 2015/0187315 A1 Jul. 2, 2015

(30) Foreign Application Priority Data

Dec. 30, 2013 (KR) ..... 10-2013-0166670

(51) Int. Cl.

| | |
|---|---|
| ***G09G 3/36*** | (2006.01) |
| ***G09G 3/20*** | (2006.01) |
| ***G09G 5/00*** | (2006.01) |

(52) U.S. Cl.

CPC ..... *G09G 3/3685* (2013.01); *G09G 3/2096* (2013.01); *G09G 5/008* (2013.01); *G09G 3/3614* (2013.01); *G09G 2370/08* (2013.01); *G09G 2370/14* (2013.01)

(58) Field of Classification Search

CPC ..... G09G 2300/0426; G09G 2310/08; G09G 3/006; G09G 3/3611; G09G 3/3688; G09G 2310/0289; G09G 2310/0297; G09G 2330/12; G09G 2370/10; G09G 3/2096; G09G 3/3614; G09G 3/3666; G09G 2370/08; G09G 2370/14; G09G 3/3685; G09G 5/008; G02F 2201/52

See application file for complete search history.

(56) References Cited

U.S. PATENT DOCUMENTS

| | | | | |
|---|---|---|---|---|
| 7,898,518 | B2 | 3/2011 | Hong et al. | |
| 7,948,465 | B2 | 5/2011 | Cho et al. | |
| 8,330,699 | B2 | 12/2012 | Hong et al. | |
| 2008/0235551 | A1* | 9/2008 | Lin | H04L 25/03019 714/746 |
| 2010/0149082 | A1* | 6/2010 | Hong | G09G 3/3611 345/88 |
| 2012/0183021 | A1* | 7/2012 | Watanabe | H04L 1/0002 375/219 |
| 2015/0179249 | A1* | 6/2015 | Park | G11C 11/40615 365/207 |

* cited by examiner

*Primary Examiner* — Kenneth Bukowski

(74) *Attorney, Agent, or Firm* — Birch, Stewart, Kolasch & Birch, LLP

(57) ABSTRACT

A display device includes a source driver integrated circuit (IC) including an equalizer for boosting a data signal received through a pair of signal lines depending on an equalization (EQ) setting value and a clock recovery circuit recovering a clock of the data signal, and a timing controller, which is connected to the source driver IC through the signal line pair and transmits the data signal to the source driver IC. The source driver IC samples the data signal in conformity with a timing of an internal clock output when the clock recovery circuit is in a lock state. The source driver IC further includes an equalizer control circuit for initializing the equalizer when the clock recovery circuit is in an unlock state and the EQ setting value is changed.

10 Claims, 11 Drawing Sheets

(a)

(b)

DISPLAY DEVICE AND METHOD FOR DRIVING THE SAME

This application claims the benefit of Korean Patent Application No. 10-2013-0166670 filed on Dec. 30, 2013, the entire contents of which is incorporated herein by reference for all purposes as if fully set forth herein.

BACKGROUND OF THE INVENTION

Field of the Invention

Embodiments of the invention relate to a display device and a method for driving the same.

Discussion of the Related Art

An active matrix liquid crystal display displays a motion picture using a thin film transistor (TFT) as a switching element. The active matrix liquid crystal display may be made to be smaller and more compact than a cathode ray tube (CRT) and thus may be applied to display units of portable information appliances, office equipments, computers, etc. Further, the active matrix liquid crystal display may be applied to televisions and thus is rapidly replacing the cathode ray tube.

A liquid crystal display includes a plurality of source driver integrated circuits (ICs) for supplying a data voltage to data lines of a liquid crystal display panel, a plurality of gate driver ICs for sequentially supplying a gate pulse (or a scan pulse) to gate lines of the liquid crystal display panel, a timing controller for controlling the source driver ICs and the gate driver ICs, and the like.

The timing controller supplies digital video data, clocks for sampling the digital video data, a control signal for controlling operations of the source driver ICs, etc. to the source driver ICs through an interface, for example, a mini low voltage differential signaling (LVDS) interface. The source driver ICs convert the digital video data received from the timing controller into an analog data voltage and supplies the analog data voltage to the data lines.

When the timing controller is connected to the source driver ICs in a multidrop manner through the mini LVDS interface, red (R) data transmission lines, green (G) data transmission lines, blue (B) data transmission lines, control lines for controlling operation timings of an output and a polarity conversion operation of the source driver ICs, clock transmission lines, etc., are required between the timing controller and the source driver ICs. In the mini LVDS interface, RGB data, for example, RGB digital video data and clocks are transmitted as differential signal pairs. Therefore, when odd data and even data are simultaneously transmitted, at least 14 lines for the transmission of the RGB data are required between the timing controller and the source driver ICs. When the RGB data is 10-bit data, 18 lines are required. Thus, many lines have to be formed on a source printed circuit board (PCB) mounted between the timing controller and the source driver ICs. Hence, it is difficult to reduce a width of the source PCB.

An embedded panel interface (EPI) protocol, which connects the timing controller with the source driver ICs in a point-to-point manner to minimize the number of lines between the timing controller and the source driver ICs and to stabilize the signal transmission, was disclosed in U.S. Pat. No. 8,330,699 (issued Dec. 11, 2012), U.S. Pat. No. 7,898,518 (issued Mar. 1, 2011), and U.S. Pat. No. 7,948,465 (issued May 24, 2011) which are hereby incorporated by reference in their entirety.

The EPI protocol satisfies the following interface regulations (1) to (3).

(1) A transmitting terminal of the timing controller is connected with receiving terminals of the source driver ICs via signal line pairs in the point-to-point manner.

(2) Separate clock line pairs are not connected between the timing controller and the source driver ICs. The timing controller transmits video data and control data along with a clock signal to the source driver ICs through the signal line pairs.

(3) A clock recovery circuit for clock and data recovery (CDR) function is embedded in each of the source driver ICs. The timing controller transmits a clock training pattern signal or a preamble signal to the source driver ICs, so that an output phase and an output frequency of the clock recovery circuit should be locked. The clock recovery circuit embedded in each source driver IC generates an internal clock when the clock training pattern signal and the clock signal are input through the signal line pairs.

When a phase and a frequency of the internal clock are locked, the source driver ICs feedback-input a lock signal of a high logic level indicating an output stabilization state to the timing controller. The lock signal is feedback-input to the timing controller through a lock feedback signal line connected to the timing controller and the last source driver IC.

As described above, in the EPI protocol, the timing controller transmits the clock training pattern signal to the source driver ICs before transmitting the control data and the video data of an input image to the source driver ICs. The clock recovery circuit of the source driver IC performs a clock training operation while outputting and recovering the internal clock based on the clock training pattern signal. When the phase and the frequency of the internal clock are stably locked, a data link, to which the video data of the input image is transmitted, is formed between the source driver ICs and the timing controller. The timing controller starts to transmit the video data and the control data to the source driver ICs in response to the lock signal received from the last source driver IC.

The application of the EPI technology has extended to various models. In recent, an attempt has been made to reduce the number of lines between the timing controller and the source driver ICs using a method for connecting the timing controller with the source driver ICs in the multidrop manner to transmit the data through the EPI. Because an amount of data to be transmitted increases when the timing controller is connected to with the source driver ICs in the point-to-point manner, a data transmission frequency in the EPI manner is greater than that in the point-to-point manner. However, the EPI manner easily distorts a waveform of a pair of signals (P, N) transmitted to the source driver ICs due to an external noise, impedance mismatching of a printed circuit board (PCB), a difference between lengths of the signal line pair of the timing controller and the source driver ICs, etc.

An equalizer for boosting an input signal may be embedded in the source driver IC. When the input signal of the source driver IC is boosted, a noise is amplified. Hence, a glitch waveform appears in an amplified signal. When the glitch waveform is input to the clock recovery circuit of the source driver IC, an output phase and an output frequency of the clock recovery circuit are not locked. Therefore, the clock recovery circuit is converted in a unlock state. Then, the timing controller transmits the clock training pattern signal to the source driver ICs in response to the lock signal of the unlock state. However, the signal of the source driver IC is boosted depending on an equalization (EQ) setting value, and the glitch waveform is again generated. Further, the clock training is repeated, and an input image is not reproduced on the screen. Hence, an abnormal noise is displayed on the screen. As a result, it is difficult to apply the EPI technology in a state where the timing controller is connected with the source driver ICs in the multidrop manner.

SUMMARY OF THE INVENTION

Embodiments of the invention provide a display device and a method for driving the same capable of preventing a malfunction of source driver integrated circuits (ICs) resulting from the boosting of a signal the source driver ICs receive.

In one aspect, there is a display device comprising a source driver integrated circuit (IC) including an equalizer configured to boost a data signal received through a pair of signal lines depending on an equalization (EQ) setting value and a clock recovery circuit configured to recover a clock of the data signal, the source driver IC configured to sample the data signal in conformity with a timing of an internal clock output when the clock recovery circuit is in a lock state, and a timing controller connected to the source driver IC through the signal line pair, the timing controller configured to transmit the data signal to the source driver IC.

The source driver IC further includes an equalizer control circuit configured to initialize the equalizer when the clock recovery circuit is in an unlock state and the EQ setting value is changed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

A display device according to an exemplary embodiment of the invention may be implemented as a flat panel display, such as a liquid crystal display (LCD), a field emission display (FED), a plasma display panel (PDP), and an organic light emitting display. In the following description, the embodiment of the invention will be described using the liquid crystal display as an example of the flat panel display. Other flat panel displays may be used.

Figure 1:
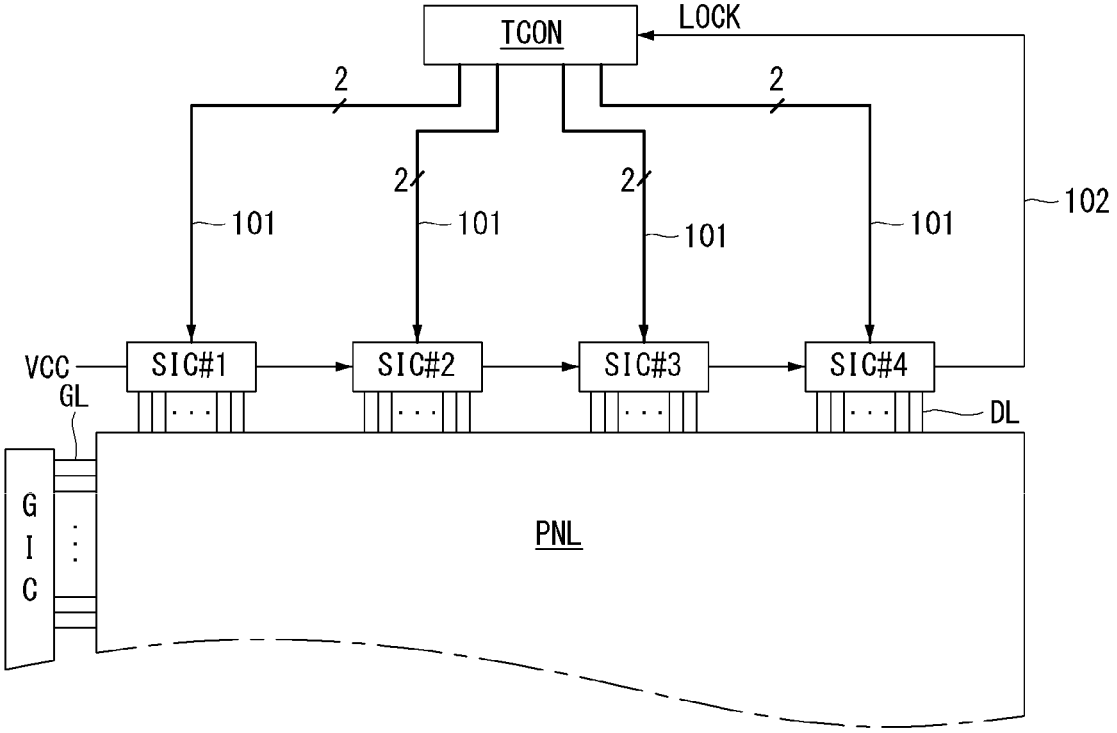
FIGS. 1 and 2 show a display device according to an exemplary embodiment of the invention.

As shown in FIG. 1, a liquid crystal display according to the embodiment of the invention includes a liquid crystal display panel PNL, a timing controller TCON, one or more source driver integrated circuits (ICs) SIC#1 to SIC#4, and gate driver ICs GIC.

A liquid crystal layer is formed between substrates of the liquid crystal display panel PNL. The liquid crystal display panel PNL includes liquid crystal cells arranged in a matrix form based on a crossing structure of data lines DL and gate lines GL.

A pixel array including the data lines DL, the gate lines GL, thin film transistors (TFTs), storage capacitors Cst, etc. is formed on a TFT array substrate of the liquid crystal display panel PNL. Each liquid crystal cell is driven by an electric field between a pixel electrode, to which a data voltage is supplied through the TFT, and a common electrode, to which a common voltage is supplied. A gate electrode of the TFT is connected to the gate line GL, and a drain electrode of the TFT is connected to the data line DL. A source electrode of the TFT is connected to the pixel electrode of the liquid crystal cell. The TFT is turned on in response to a gate pulse supplied through the gate line GL and supplies the data voltage from the data line DL to the pixel electrode of the liquid crystal cell. Black matrixes, color filters, the common electrodes, etc. are formed on a color filter substrate of the liquid crystal display panel PNL. Polarizing plates are respectively attached to the TFT array substrate and the color filter substrate of the liquid crystal display panel PNL. Alignment layers for setting a pre-tilt angle of liquid crystals are respectively formed on the TFT array substrate and the color filter substrate of the liquid crystal display panel PNL. A spacer may be formed between the TFT array substrate and the color filter substrate of the liquid crystal display panel PNL to keep a cell gap of the liquid crystal cells constant.

The liquid crystal display panel PNL may be implemented in a vertical electric field driving manner such as a twisted nematic (TN) mode and a vertical alignment (VA) mode or in a horizontal electric field driving manner such as an in-plane switching (IPS) mode and a fringe field switching (FFS) mode. The liquid crystal display according to the embodiment of the invention may be implemented as any type liquid crystal display including a transmissive liquid crystal display, a transflective liquid crystal display, and a reflective liquid crystal display. The transmissive liquid crystal display and the transflective liquid crystal display require a backlight unit. The backlight unit may be implemented as a direct type backlight unit or an edge type backlight unit.

Signal line pairs 101 are respectively connected between the timing controller TCON and the source driver ICs SIC#1 to SIC#4 and transmit differential signal pairs of EPIC data to the source driver ICs SIC#1 to SIC#4. A lock line 102 is connected between the timing controller TCON and the last source driver IC SIC#4 and transmits a lock signal LOCK to the timing controller TCON.

The timing controller TCON receives external timing signals, such as a vertical sync signal Vsync, a horizontal sync signal Hsync, an external data enable signal DE, and a main clock CLK, from an external host system (not shown) through an interface, such as a low voltage differential signaling (LVDS) interface and a transition minimized differential signaling (TMDS) interface. The timing controller TCON converts a clock training pattern signal CT, control data CTR, and pixel data RGB into differential signal pairs of a low voltage based on an embedded panel interface (EPI) protocol and transmits them to the source driver ICs SIC#1 to SIC#4 through the signal line pairs 101. The clock training pattern signal CT, the control data CTR, and the pixel data RGB each include an EPI clock.

A clock recovery circuit of each of the source driver ICs SIC#1 to SIC#4 generates the lock signal LOCK of a high logic level indicating a lock state when a phase and a frequency of an internal clock recovered from the received EPI clock are locked. On the other hand, the clock recovery circuit of each of the source driver ICs SIC#1 to SIC#4 generates the lock signal LOCK of a low logic level indicating a unlock state when the phase and the frequency of the internal clock recovered from the received EPI clock are unlocked. The lock signal LOCK is transmitted to the next source driver IC. The last source driver IC SIC#4 transmits the lock signal LOCK to the timing controller TCON through the lock line 102. A power voltage VCC is input to a lock signal input terminal of the first source driver IC SIC#1.

The timing controller TCON transmits the clock training pattern signal CT to the source driver ICs SIC#1 to SIC#4 when the lock signal LOCK is at the low logic level. When the level of the lock signal LOCK is inverted to the high logic level, the timing controller TCON starts to transmit the control data CTR and the pixel data RGB of an input image to the source driver ICs SIC#1 to SIC#4.

The EPI clock is input to the clock recovery circuit of each of the source driver ICs SIC#1 to SIC#4. The clock recovery circuit generates internal clocks of {(the number of RGB bits of video data)×2} using a delay locked loop (DLL). Further, the DLL generates the lock signal LOCK. The clock recovery circuit may use a phase locked loop (PLL) instead of the DLL. The source driver ICs SIC#1 to SIC#4 sample video data bits of the input image in conformity with timing of the internal clocks and then convert the sampled pixel data into parallel data.

The source driver ICs SIC#1 to SIC#4 decode the control data CTR input through the signal line pairs 101 in a code mapping method and recover source control data and gate control data. The source driver ICs SIC#1 to SIC#4 convert the video data of the input image into positive and negative analog video data voltages in response to the recovered source control data and supply the data voltages to the data lines DL of the liquid crystal display panel PNL. The source driver ICs SIC#1 to SIC#4 may transmit the gate control data to at least one of the gate driver ICs GIC.

The gate driver ICs GIC sequentially supply gate pulses synchronized with the positive and negative analog video data voltages to the gate lines GL of the liquid crystal display panel PNL in response to the gate control data, which is directly received from the timing controller TCON or is received through the source driver ICs SIC#1 to SIC#4.

Figure 2:
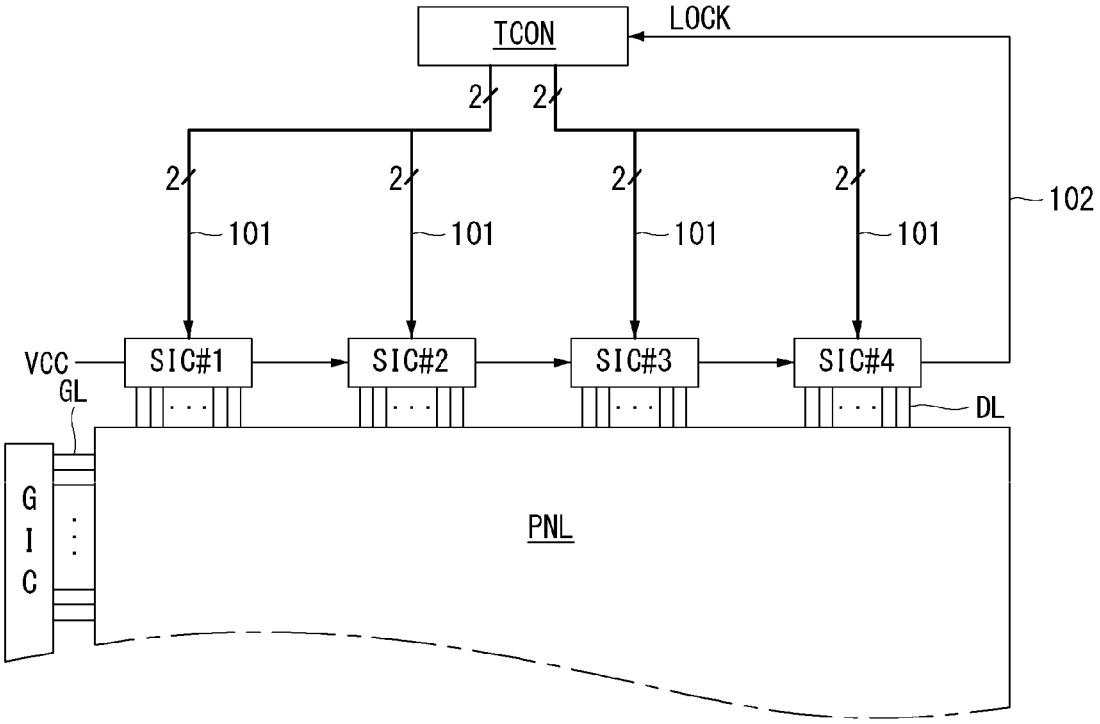

As shown in FIG. 2, the timing controller TCON may be connected to N source driver ICs through a pair of signal lines 101 in a multidrop manner and may simultaneously transmit differential signal pairs of EPI data to the N source driver ICs, where N is a positive integer equal to or greater than 2.

Figure 3:
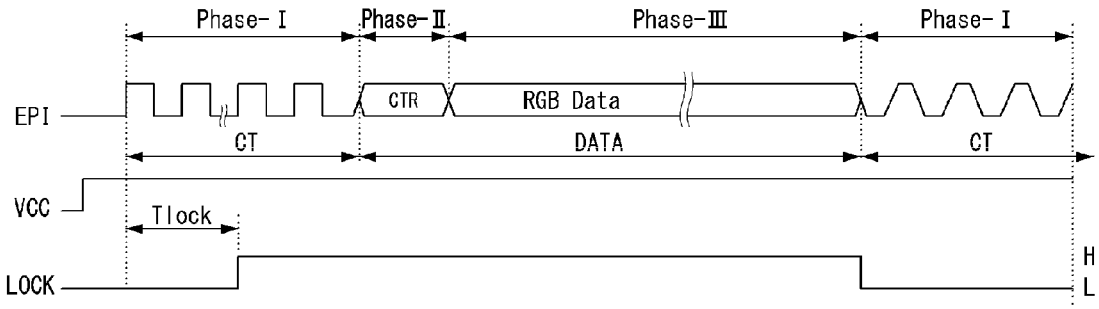
FIG. 3 is a waveform diagram showing an example of an embedded panel interface (EPI) protocol for signal transmission between a timing controller and source driver integrated circuits (ICs) according to an embodiment of the invention.
Figure 4:
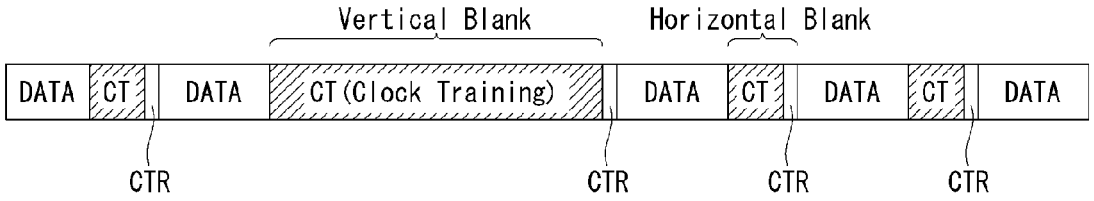
FIG. 4 shows an example of a clock training pattern signal, control data, and a bit stream of pixel data according to an embodiment of the invention.

FIG. 3 is a waveform diagram showing the EPI protocol for the transmission of the EPI data between the timing controller TCON and the source driver ICs SIC#1 to SIC#4. FIG. 4 shows the clock training pattern signal, the control data, and a bit stream of the pixel data.

As shown in FIGS. 3 and 4, the timing controller TCON transmits the clock training pattern signal CT of a predetermined frequency to the source driver ICs SIC#1 to SIC#4 during a period of a first stage Phase-I. When the lock signal LOCK of a high logic level H is input through the lock line 102, the timing controller TCON performs the transmission of a signal of a second stage Phase-II. During a period of the second stage Phase-II, the timing controller TCON transmits the control data CTR to the source driver ICs SIC#1 to SIC#4. When the lock signal LOCK is maintained at the high logic level H, the timing controller TCON performs the transmission of a signal of a third stage Phase-III. During a period of the third stage Phase-III, the timing controller TCON transmits the pixel data (i.e., RGB data) of the input image to the source driver ICs SIC#1 to SIC#4.

In FIG. 3, "Tlock" is a time ranging from after the clock training pattern signal CT starts to be transmitted to the source driver ICs SIC#1 to SIC#4 until an output phase and an output frequency of the clock recovery circuits of the source driver ICs SIC#1 to SIC#4 are locked and the lock signal LOCK is inverted to the high logic level H.

When the lock signal LOCK of a low logic level L is input from the last source driver IC SIC#4, the timing controller TCON performs an operation of the first stage Phase-I and transmits the clock training pattern signal CT to the source driver ICs SIC#1 to SIC#4, so as to resume the clock training of the source driver ICs SIC#1 to SIC#4.

The clock training pattern signal CT may be transmitted to the source driver ICs SIC#1 to SIC#4 during a vertical blank period. The vertical blank period means a period, in which there is no data enable signal DE between an Nth frame period and an (N+1)th frame period, where N is a positive integer. In the vertical blank period, the pixel data of the input image is not input to the timing controller TCON. The control data CTR may be transmitted in a horizontal blank period. The horizontal blank period means a period, in which there is no data enable signal DE in an Nth horizontal period, in which pixel data of an Nth line is transmitted, and an (N+1)th horizontal period, in which pixel data of an (N+1)th line is transmitted.

Figure 5:
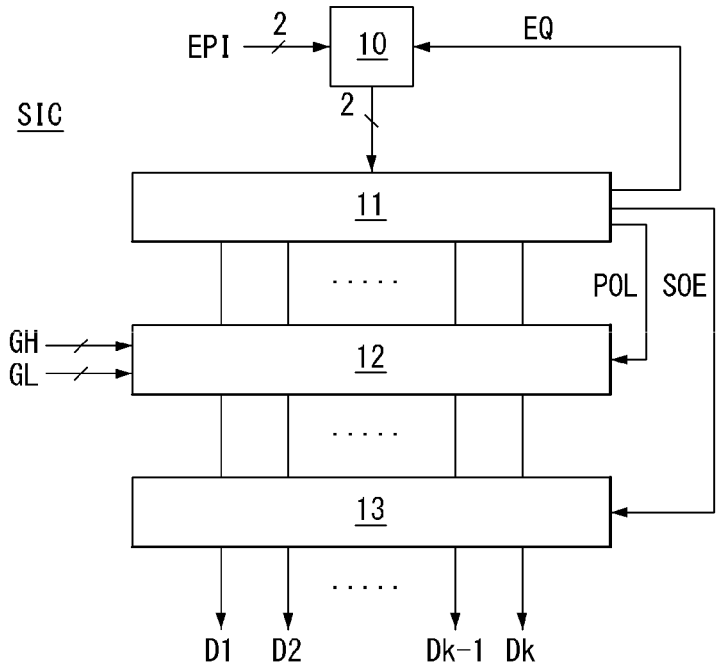
FIG. 5 shows in detail a source driver IC according to an embodiment of the invention.

FIG. 5 shows internal circuit configuration of the source driver IC.

As shown in FIG. 5, each of the source driver ICs SIC#1 to SIC#4 supplies the positive and negative analog data voltages to k data lines D1 to Dk, where k is a positive integer.

Each of the source driver ICs SIC#1 to SIC#4 includes an equalizer 10, a data sampling and deserializer 11, a digital-to-analog converter (DAC) 12, an output circuit 13, and the like.

The equalizer 10 may amplify an output of a receiving terminal Rx of the source driver IC SIC depending on an equalization (EQ) setting value. The EQ setting value is encoded to the control data CTR and is transmitted to the source driver IC SIC. The EQ setting value may be the following data of 2 bits EQ1 and EQ2.

EQ1 and EQ2=LL (or 00): Equalizer OFF

EQ1 and EQ2=LH (or 01): Low Boost

EQ1 and EQ2=HL (or 10): Mid Boost

EQ1 and EQ2=HH (or 11): High Boost

When EQ1 and EQ2 are 01, 10, and 11, the equalizer 10 boosts a received signal so that a low logic level of the signal is a lower value and a high logic level of the signal is a higher value, thereby amplifying the signal. When EQ1 and EQ2 are 00, the equalizer 10 does not boost the received signal and supplies the signal to the data sampling and deserializer 11. The EQ setting value is recovered by the data sampling and deserializer 11 and is input to the equalizer 10.

The data sampling and deserializer 11 recovers the EPI clocks received from the timing controller TCON using the DLL, generates the internal clocks, and samples the received data bits at timing of each internal clock. The data sampling and deserializer 11 latches the sampled data bits and then outputs simultaneously the data bits. Hence, the data bits are converted into parallel data.

The data sampling and deserializer 11 samples the received control data based on the internal clock and recovers the source control data. When the gate control data is encoded to the control data, the data sampling and deserializer 11 recovers the gate control data and transmits the recovered gate control data to the gate driver IC GIC. The source control data may include a source output enable signal SOE, a polarity control signal POL, etc. The polarity control signal POL indicates polarities of the positive and negative analog data voltages supplied to the data lines D1 to Dk. The source output enable signal SOE controls data output timing and charge sharing timing of the source driver IC SIC. When the display devices other than the liquid crystal display are used, the polarity control signal POL may be omitted. The gate control data includes a gate start pulse, a gate output enable signal, etc.

The DAC 12 converts the video data received from the data sampling and deserializer 11 into a positive gamma compensation voltage GH and a negative gamma compensation voltage GL and generates the positive and negative analog data voltages. The DAC 12 inverts the polarity of the data voltage in response to the polarity control signal POL.

The output circuit 13 supplies an average voltage of the positive data voltage and the negative data voltage or a half VDD voltage HVDD to the data lines D1 to Dk through the charge sharing during a high logic period of the source output enable signal SOE. During a period of the charge sharing, an output channel of the source driver IC SIC supplying the positive data voltage and an output channel of the source driver IC SIC supplying the negative data voltage are short-circuited, and thus the average voltage of the positive data voltage and the negative data voltage is supplied to the data lines D1 to Dk. The output circuit 13 supplies the positive and negative analog data voltages to the data lines D1 to Dk through an output buffer during a low logic period of the source output enable signal SOE.

Figure 6:
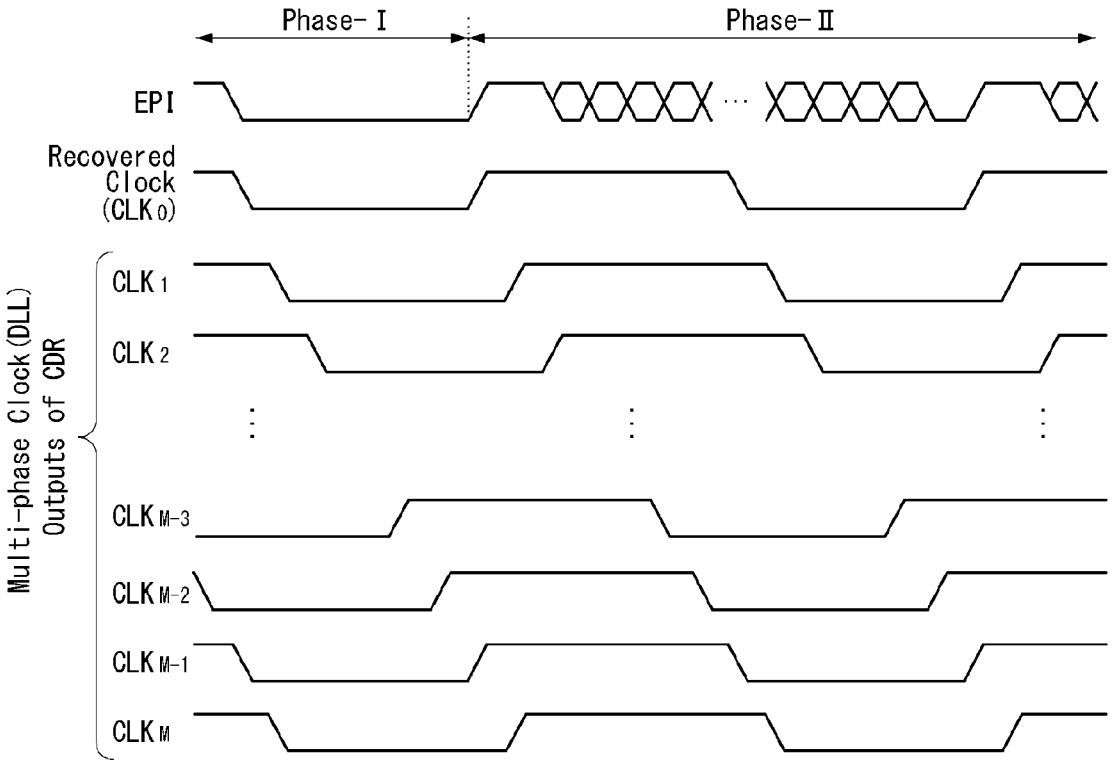
FIG. 6 is a waveform diagram showing an example of internal clocks of a multiphase recovered by a delay locked loop (DLL) according to an embodiment of the invention.

The clock recovery circuit of each source driver IC may be implemented as the DLL. As shown in FIG. 6, the DLL generates a reference clock CLK0 at edge timing of the EPI clock of the received signal and sequentially delays the reference clock CLK0. Hence, the DLL recovers clocks CLK1 to CLKM of a multiphase having a predetermined time interval and generates the internal clocks. The data sampling and deserializer 11 samples data bit in conformity with a clock synchronized with center data bit among the internal clocks.

Figure 7:
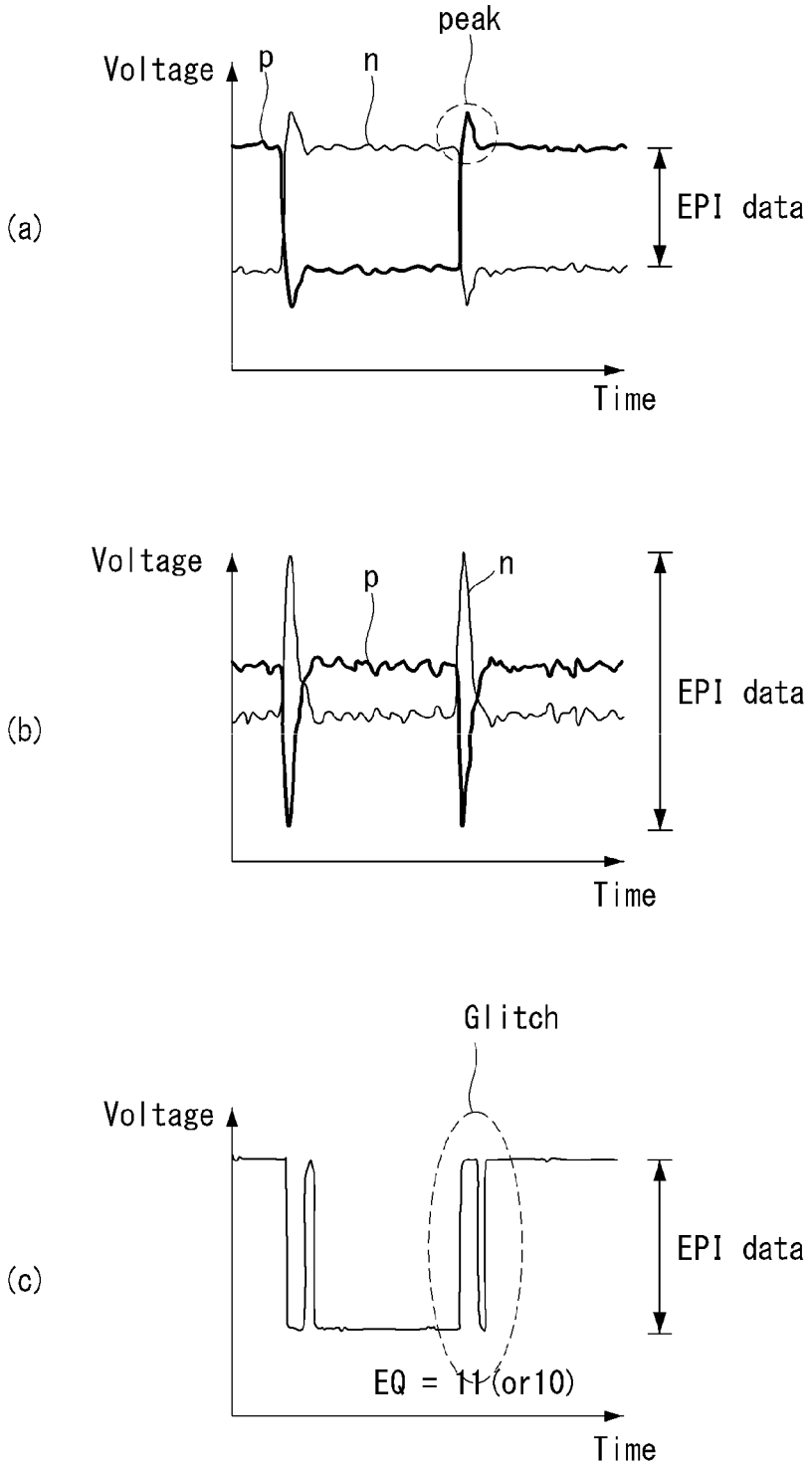
FIG. 7 is a waveform diagram showing an example where a glitch waveform is generated by boosting of an equalizer according to an embodiment of the invention.

FIG. 7 is a waveform diagram showing an example where a glitch waveform is generated by the boosting of the equalizer.

As shown in (a) of FIG. 7, a low or high logic level of data bit is determined at a position where a pair of signals (p, n) of EPI data transmitted to the source driver IC meet each other. The signal pair (p, n) may include a noise of a peak component at a transition where the voltage changes. As shown in (b) of FIG. 7, the equalizer 10 boosts the signal pair (p, n) of the EPI data so that the low logic level and the high logic level in the signal pair (p, n) respectively have a lower value and a higher value. Therefore, the peak component in the received signal pair further increases. As shown in (c) of FIG. 7, the amplified peak component is changed into the glitch waveform.

Figure 8:
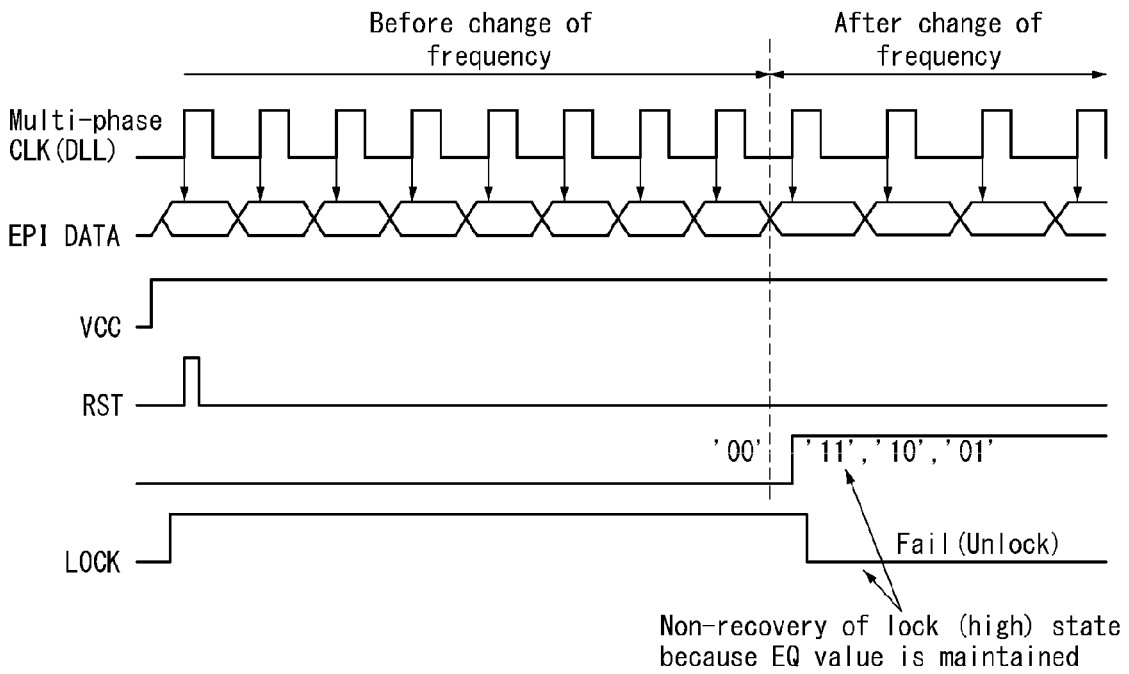
FIG. 8 shows an example where a delay locked loop is maintained in a unlock state when a frequency varies according to an embodiment of the invention.

As shown in FIG. 8, when a transmission frequency of the EPI data transmitted by the timing controller TCON changes, an output frequency of the equalizer 10 changes. Because the DLL requires a delay time for recovering the clock, the edge timing of the clock is not accurately detected from the EPI data output from the equalizer 10 for the delay time. In FIG. 8, "RST" is the internal signal of the source driver IC generated after the output of the clock recovery circuit of each source driver IC is stably locked.

When the glitch waveform is generated by the overboosting of the equalizer 10, the DLL misrecognizes clock edge timing of the clock training pattern signal CT. Therefore, the DLL does not recover the clock and reduces the level of the lock signal LOCK to the low logic level. The timing controller TCON transmits the clock training pattern signal CT to the source driver IC in response to the lock signal LOCK of the low logic level. However, the received signal pair is again boosted by the equalizer 10, and the DLL is maintained in the unlock state. Because the timing controller TCON continuously transmits the clock training pattern signal CT until the phase of the DLL is again locked, an abnormal image is displayed on the screen. The interface connection structure of the multidrop manner shown in FIG. 2 is weaker to the above problem because the frequency of the EPI data is high.

Figure 9:
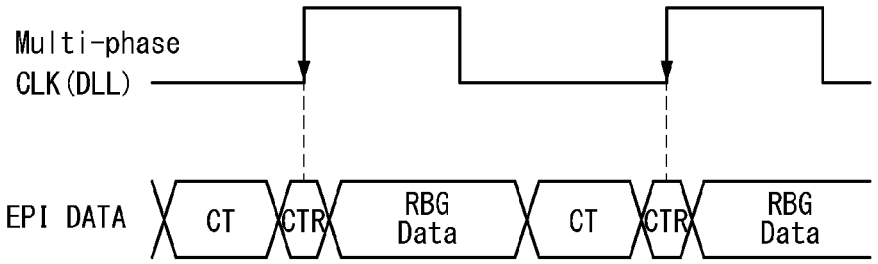
FIG. 9 is a waveform diagram showing a comparison of data sampling timings before and after a frequency changes according to an embodiment of the invention.
Figure 9:
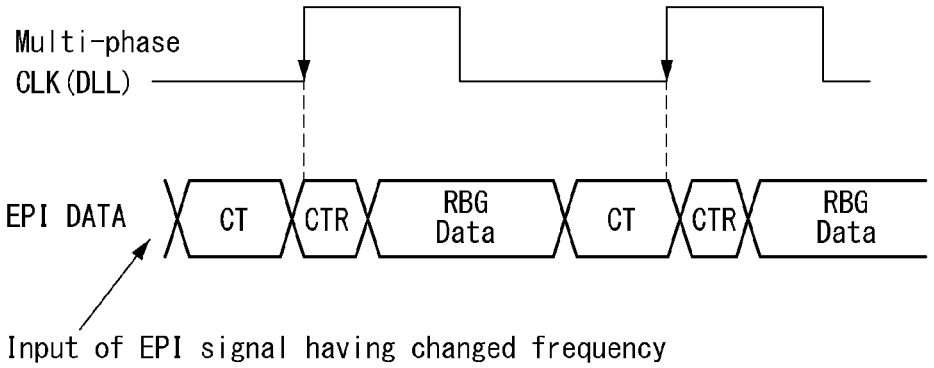

FIG. 9(*a*) shows a sampling timing of DLL clocks and the EPI data synchronized with rising edges of the DLL clocks in a normal state before the frequency changes. FIG. 9(*b*) shows a sampling error of the control data CTR for a delay time (for example, several μs) of the DLL when the frequency of the EPI data changes. When information sampled from the clock training pattern signal CT is misrecognized as the EQ setting value '10', '01', or '11', the equalizer 10 repeatedly overboosts because of the misrecognized EQ setting value and outputs the glitch waveform. When the glitch waveform is input to the DLL, the timing controller TCON continuously transmits the clock training pattern signal CT to the source driver ICs SIC#1 to SIC#4 because the DLL is maintained in the unlock state.

Figure 10:
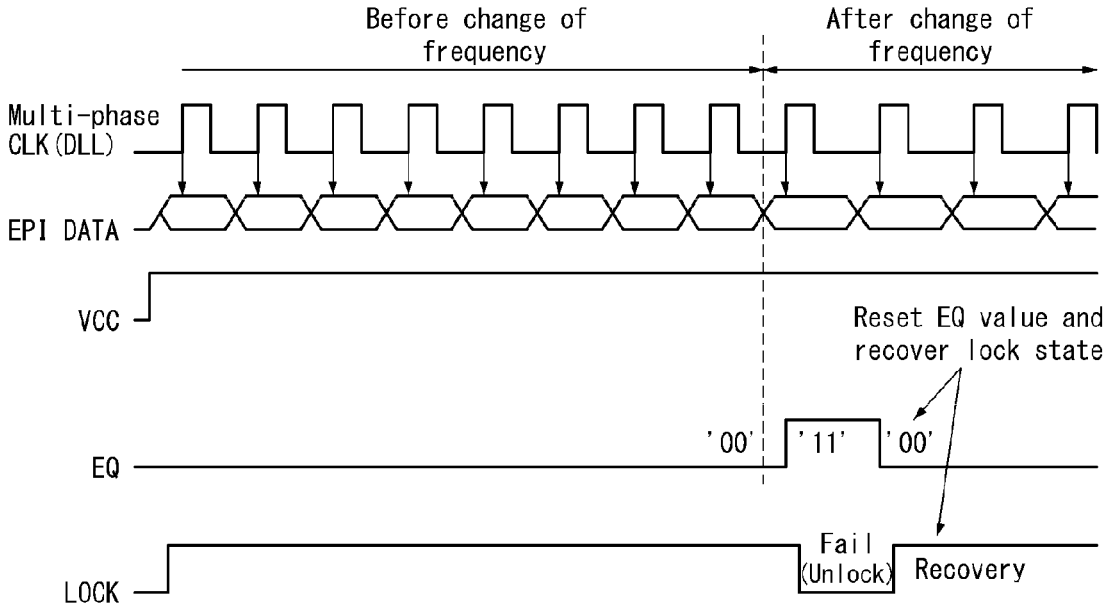
FIG. 10 is a waveform diagram showing an effect, in which a delay locked loop (DLL) is rapidly converted into a lock state by initializing an equalizer when the DLL is in an unlock state according to an embodiment of the invention.

FIG. 10 is a waveform diagram showing an effect, in which the DLL is rapidly converted into the lock state by initializing the equalizer when the DLL is in the unlock state.

As shown in FIG. 10, the display device according to the embodiment of the invention changes the EQ setting value to an initial value when the DLL is in the unlock state and the EQ setting value is not the initial value, thereby initializing the equalizer 10. When the equalizer 10 is initialized to the initial value 'LL' (or '00'), the equalizer 10 does not overboost the received signal pair. Therefore, the display device according to the embodiment of the invention may prevent the generation of the glitch waveform. As a result, the DLL rapidly detects the clock edge timing from the input signal, in which there is no glitch waveform, and locks the phase and the frequency of the internal clock. The DLL may change the lock signal LOCK to the high logic level.

Figure 11:
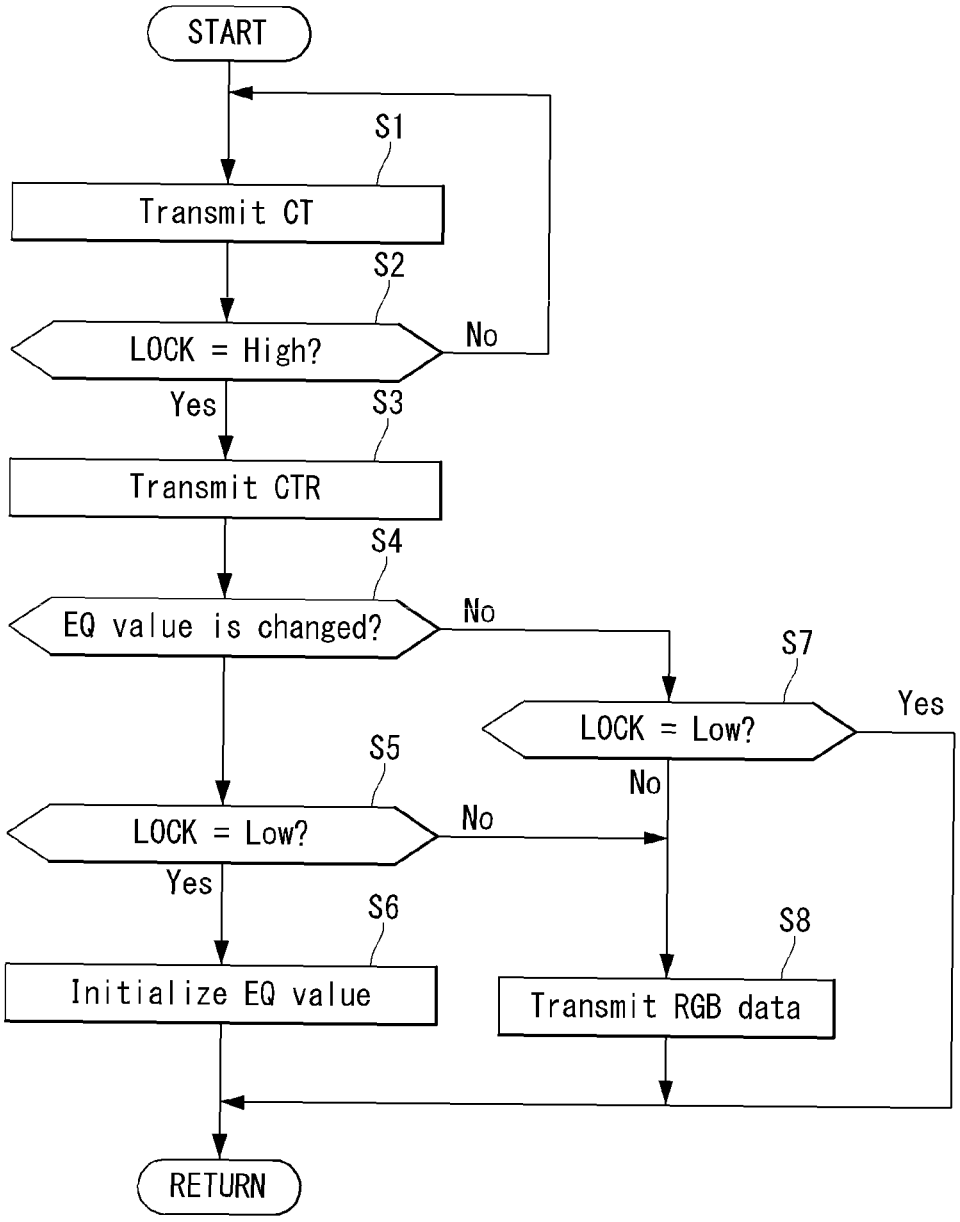
FIG. 11 is a flow chart showing a method for driving a display device according to an exemplary embodiment of the invention.

FIG. 11 is a flow chart showing a method for driving the display device according to the embodiment of the invention.

As shown in FIG. 11, the timing controller TCON transmits the clock training pattern signal CT to the source driver ICs SIC#1 to SIC#4 during a period of the first stage Phase-I in step S1. When the lock state (=high logic level) is input to the DLL through the lock line 102, the timing controller TCON performs the transmission of a signal of the second stage Phase-II in step S2. During a period of the second stage Phase-II, the timing controller TCON transmits the control data CTR to the source driver ICs SIC#1 to SIC#4 in step S3.

Figure 12:
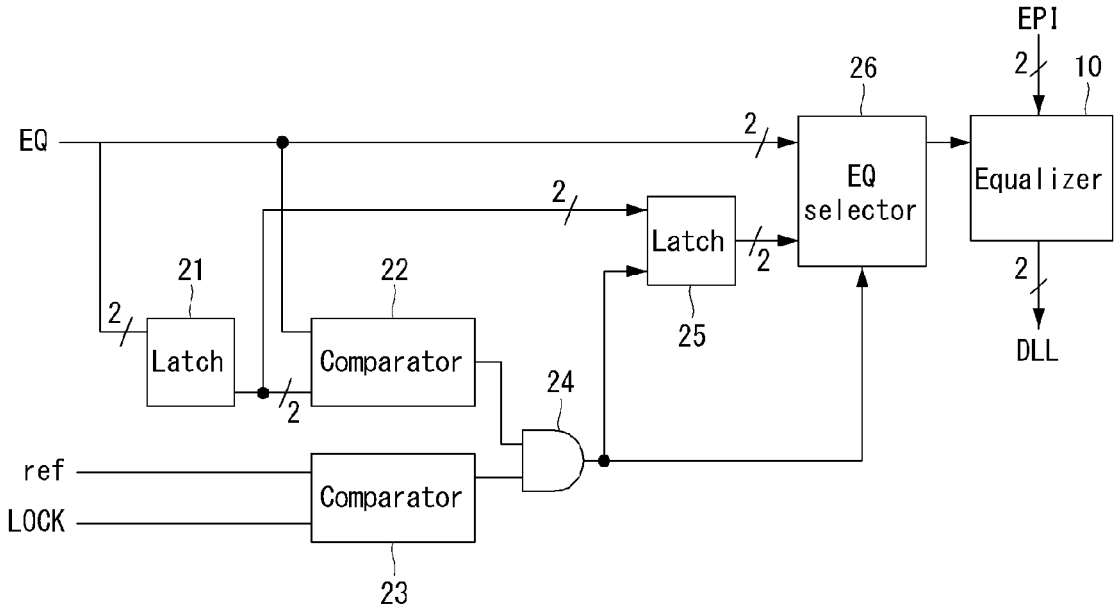
FIG. 12 is a circuit diagram of an equalizer control circuit according to an embodiment of the invention.

An equalizer control circuit shown in FIG. 12 senses the EQ setting value and initializes the EQ setting value when the EQ setting value is changed and the DLL is in the unlock state, in steps S4 to S6.

When the DLL is in the lock state (=high logic level), the timing controller TCON transmits the pixel data RGB of the input image subsequent to the control data CTR to the source driver ICs SIC#1 to SIC#4 in steps S7 and S8.

FIG. 12 is a circuit diagram of the equalizer control circuit.

As shown in FIG. 12, the equalizer control circuit is connected between the equalizer 10 and the data sampling and deserializer 11 in each of the source driver ICs SIC#1 to SIC#4. The equalizer control circuit initializes the equalizer 10 when the EQ setting value is changed and the DLL is in the unlock state.

The equalizer control circuit of each of the source driver ICs SIC#1 to SIC#4 includes first and second latches 21 and 25, first and second comparators 22 and 23, an AND gate 24, and an EQ selector 26.

The first latch 21 stores an initial EQ setting value sampled in an initial driving stage, in which the DLL is stabilized in the lock state and starts to generate the internal clock. The first comparator 22 compares the initial EQ setting value with a current EQ setting value and generates an output of a high logic level when the current EQ setting value is different from the initial EQ setting value. The second comparator 23 compares a reference value ref with the lock signal LOCK and generates an output of a high logic level when the lock signal LOCK is less than the reference value ref.

The AND gate 24 performs an AND operation on the outputs of the first and second comparators 22 and 23 and outputs a result of the AND operation. Thus, the AND gate 24 detects a timing at which the DLL is unlocked and the EQ setting value is changed.

The second latch 25 stores the EQ setting value from the first latch 21 when an output of the AND gate 24 is the high logic level. When the output of the AND gate 24 is the high logic level, the EQ selector 26 supplies an output of the second latch 25 to the equalizer 10 as the EQ setting value. On the other hand, when the output of the AND gate 24 is the low logic level, the EQ selector 26 supplies a current EQ setting value to the equalizer 10.

The DLL and the PLL are used as the clock recovery circuit of each of the source driver ICs SIC#1 to SIC#4 for synchronizing a phase of an input signal with a phase of an output signal. Thus, when even the source driver IC using the PLL as well as the DLL as the clock recovery circuit misrecognizes the EQ setting value, the embodiment of the invention initializes the EQ setting value through the above-described method and may prevent a malfunction of the source driver IC.

As described above, the embodiments of the invention initialize the equalizer when the clock recovery circuit of the source driver IC is in the unlock state and the EQ setting value is changed, thereby preventing the generation of the glitch waveform. As a result, the embodiments of the invention may prevent the malfunction of the source driver IC due to the boosting of the received signal of the source driver IC.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a source driver integrated circuit (IC) including an equalizer configured to boost a data signal received through a pair of signal lines depending on a logic level of an equalization (EQ) setting value and a clock recovery circuit configured to recover a clock of the data signal, the source driver IC configured to sample the data signal in conformity with a timing of an internal clock output when the clock recovery circuit is in a lock state; and a timing controller connected to the source driver IC through the signal line pair, the timing controller configured to transmit the data signal to the source driver IC, wherein the source driver IC further includes an equalizer control circuit configured to initialize the equalizer when the clock recovery circuit is in an unlock state and the EQ setting value is changed, and wherein the equalizer control circuit includes:

a first comparator configured to compare an initial EQ setting value sampled in an initial drive of the source driver IC with the EQ setting value, and detect when the EQ setting value is different from the initial EQ setting value;

a second comparator configured to detect the unlock state of the clock recovery circuit;

an AND gate configured to detect when the EQ setting value is changed and the clock recovery circuit is in the unlock state; and an EQ selector configured to supply the initial EQ setting value to the equalizer when the EQ setting value is changed and the clock recovery circuit is in the unlock state.

2. The display device of claim 1, wherein the clock recovery circuit includes a delay locked loop.

3. The display device of claim 1, wherein the timing controller is connected to N source driver ICs through the signal line pairs, where N is a positive integer equal to or greater than 2.

4. A display device comprising:

a source driver integrated circuit (IC) including an equalizer configured to boost a data signal received through a pair of signal lines depending on a logic level of an equalization (EQ) setting value and a clock recovery circuit configured to recover a clock of the data signal, the source driver IC configured to sample the data signal in conformity with a timing of an internal clock output when the clock recovery circuit is in a lock state; and a timing controller connected to the source driver IC through the signal line pair, the timing controller configured to transmit the data signal to the source driver IC, wherein the source driver IC further includes an equalizer control circuit configured to initialize the equalizer when the clock recovery circuit is in an unlock state and the EQ setting value is changed, and wherein the equalizer control circuit includes:

a first latch configured to store an initial EQ setting value sampled in an initial drive of the source driver IC;

a first comparator configured to compare the initial EQ setting value with a current EQ setting value and detect when the current EQ setting value is different from the initial EQ setting value;

a second comparator configured to detect the unlock state of the clock recovery circuit;

an AND gate configured to detect when the EQ setting value is changed and the clock recovery circuit is in the unlock state in response to outputs of the first and second comparators;

a second latch configured to store the initial EQ setting value when the EQ setting value is changed and the clock recovery circuit is in the unlock state in response to an output of the AND gate; and an EQ selector configured to supply the initial EQ setting value to the equalizer when the EQ setting value is changed and the clock recovery circuit is in the unlock state in response to the output of the AND gate.

5. The display device of claim 4, wherein the clock recovery circuit includes a delay locked loop.

6. The display device of claim 4, wherein the timing controller is connected to N source driver ICs through the signal line pairs, where N is a positive integer equal to or greater than 2.

7. A method for driving a display device including a timing controller transmitting a data signal to a source driver integrated circuit (IC) through a pair of signal lines, the method comprising:

boosting, via an equalizer of the source driver IC, the data signal received through the signal line pair depending on a logic level of an equalization (EQ) setting value in the equalizer;

initializing, via an equalizer control circuit of the source driver IC, the equalizer when a clock recovery circuit recovering a clock of the data signal is in an unlock state and the EQ setting value is changed;

comparing, via a first comparator of the equalizer control circuit, an initial EQ setting value with the EQ setting value and detecting when the EQ setting value is different from the initial EQ setting value;

detecting, via a second comparator of the equalizer control circuit, the unlock state of the clock recovery circuit;

detecting, via an AND gate of the equalizer control circuit, when the EQ setting value is changed and the clock recovery circuit is in the unlock state; and supplying, via an EQ selector of the equalizer control circuit, the initial EQ setting value to the equalizer when the EQ setting value is changed and the clock recovery circuit is in the unlock state.

8. The method of claim 7, further comprising:

storing, via a first latch of the equalizer control circuit, the initial EQ setting value sampled in an initial drive of the source driver IC; and storing, via a second latch of the equalizer control circuit, the initial EQ setting value when the EQ setting value is changed and the clock recovery circuit is in the unlock state in response to an output of the AND gate.

9. The method of claim 7, wherein the clock recovery circuit includes a delay locked loop.

10. The method of claim 7, wherein the timing controller is connected to N source driver ICs through the signal line pairs, where N is a positive integer equal to or greater than 2.

* * * * *